US006065433A

United States Patent [19]

Hill

[11] Patent Number: 6,065,433

[45] Date of Patent: May 23, 2000

[54] VARIABLE DISPLACEMENT METERING PUMP

[76] Inventor: Raymond John Hill, 4 Heartleap Lane, Beldon. W.A. 6027, Australia

[21] Appl. No.: 08/973,472

[22] PCT Filed: Jun. 28, 1996

[86] PCT No.: PCT/AU96/00404

§ 371 Date: Dec. 16, 1997

§ 102(e) Date: Dec. 16, 1997

[87] PCT Pub. No.: WO97/02424

PCT Pub. Date: Jan. 23, 1997

[30] Foreign Application Priority Data

Jun. 30, 1995 [AU] Australia ..... PN3915

[51] Int. Cl.[7] ..... F02M 37/04

[52] U.S. Cl. ..... 123/73 CC; 123/DIG. 5; 123/495; 417/380

[58] Field of Search ..... 123/DIG. 5, 73 C, 123/73 CC, 73 PP, 495; 417/212, 374, 380

[56] References Cited

U.S. PATENT DOCUMENTS

| | | | |
|---|---|---|---|
| 3,909,159 | 9/1975 | Jansen | 417/374 |
| 4,700,668 | 10/1987 | Schierling et al. | 123/73 |
| 4,807,593 | 2/1989 | Schierling et al. | 123/73 |
| 4,884,405 | 12/1989 | Schatz | 417/380 |
| 5,337,710 | 8/1994 | Adam | 123/DIG. 5 |
| 5,365,893 | 11/1994 | Wissman et al. | 123/DIG. 5 |
| 5,377,637 | 1/1995 | Leighton et al. | 123/73 |
| 5,685,272 | 11/1997 | Paul et al. | 417/380 |
| 5,700,402 | 12/1997 | Jones et al. | 123/DIG. 5 |
| 5,785,505 | 7/1998 | Price | 417/380 |
| 5,832,882 | 11/1998 | Matsuda et al. | 123/DIG. 5 |

FOREIGN PATENT DOCUMENTS

| | | |
|---|---|---|
| 20148/95 | 7/1994 | Australia . |
| 59080/94 | 10/1994 | Australia . |
| 0 060 184 | 3/1981 | European Pat. Off. . |
| 2 496 170 | 12/1981 | France . |
| 31 00 725 A1 | 7/1982 | Germany . |

OTHER PUBLICATIONS

Patent Abstracts of Japan, M364, pp. 45, JP 59–19074A.

*Primary Examiner*—Thomas N. Moulis
*Attorney, Agent, or Firm*—Arent Fox Kintner Plotkin & Kahn PLLC

[57] ABSTRACT

A fluid metering pump (1) is disclosed which is operated by a source of pressurised fluid, which in the case of a pump for metering fuel, may be the crankcase (37) of a two stroke, crankcase scavenged, internal combustion engine. The metered quantity of fluid displaced by the pump (1) is a function of the pressure of the pressurised fluid and time that the pressure acts on a pumping means (15) of the pump (1). Attenuation of the pressure may be achieved, especially under idle or high engine speed conditions in the case of an engine, by a throttle (35) placed in a conduit (33) communicating an actuation chamber of the pump (1) with the source of pressurised fluid, such as the crankcase of a two stroke engine.

17 Claims, 1 Drawing Sheet

VARIABLE DISPLACEMENT METERING PUMP

Figure 1:
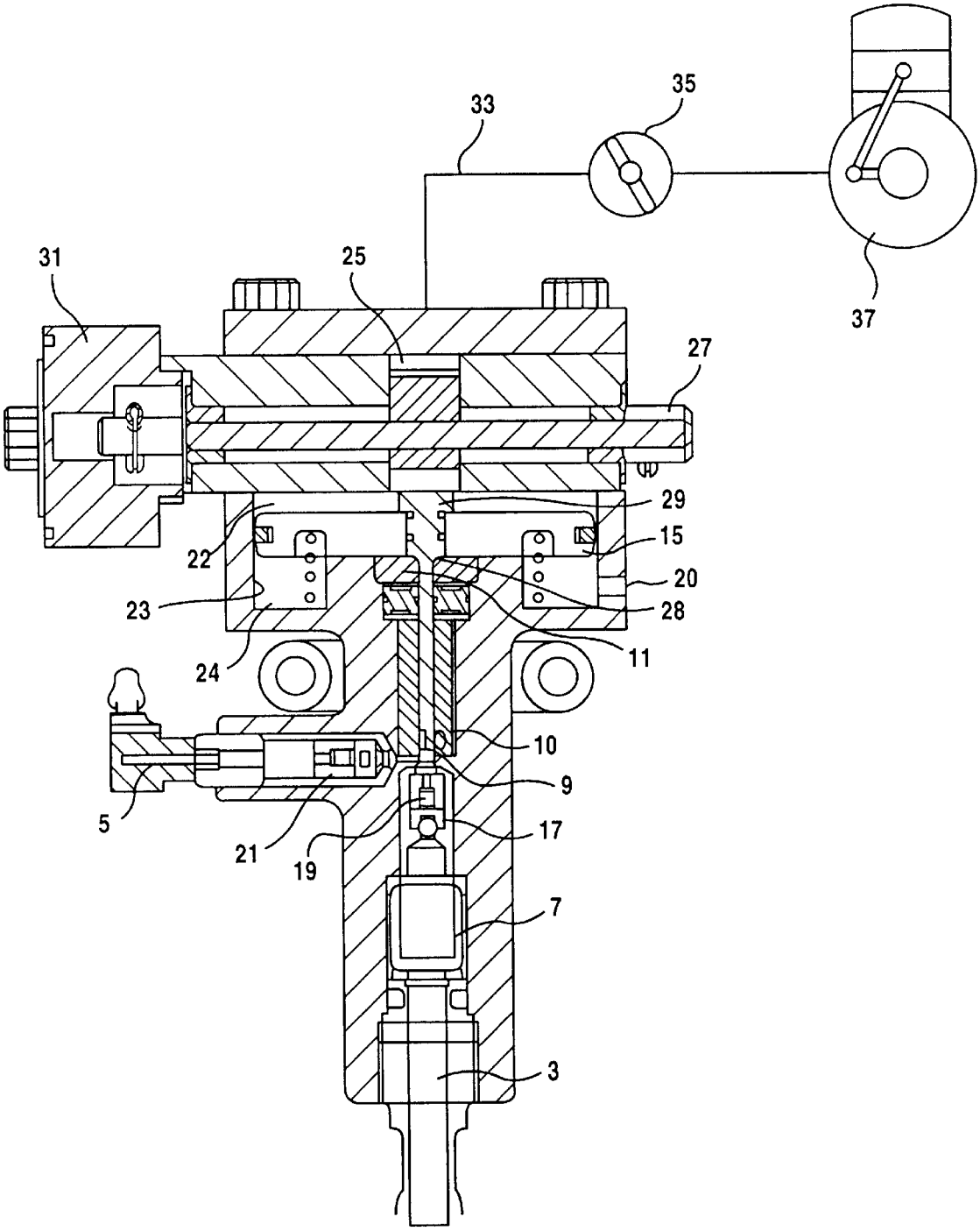

This invention relates to pumps and, in particular, to pumps suitable for metering fuel to an internal combustion engine.

Direct injected internal combustion engines have been devised as a means of achieving efficient combustion of fuel so as to minimise exhaust emissions, especially in automotive engines. The efficiency with which direct injected internal combustion engines achieve this objective depends very much on the accuracy of metering of quantities of fuel for delivery to the combustion chamber(s) of such engines.

This imposes a requirement on pumps designed for metering fuel for delivery to the combustion chamber(s) of the engine that the volume of fuel delivered thereby is able to be carefully controlled. In this manner, a greater accuracy of the quantity of fuel delivered to the combustion chamber (s) may be achieved.

This need for accurate fuel control is particularly acute in systems which run "open-loop" on fuelling rate. In such open loop systems, the operator demand is translated directly into a required fuel metering rate, with the air flow to the engine being controlled as a secondary variable.

Some fuel metering pumps presently used in internal combustion engines are variable displacement pumps in which the volume of fuel delivered thereby is controlled by the stroke of a piston provided in the pump. To ensure that the correct stroke setting is attained, a cam or other positive physical stop means may also be employed in the pump. Such a cam or physical stop means typically will be arranged to alter the displacement of the piston within its working cylinder within the pump. Hence, any trimming used to control fuelling level, especially at idle or under high speed conditions, requires mechanical adjustment of the position of the physical stop means. In the past, such mechanical adjustment has been achieved on certain fuel systems by an electro-mechanical device such as a stepper motor which adjusts the position of a cam acting on the piston of the fuel metering pump. The operation of the stepper motor has typically been under the control of an electronic control unit (ECU).

Such control generally results in complexity with respect to both hardware requirements and the design of suitable control algorithms therefor. With such complexity has arisen expense associated with the cost of the stepper motor and, to a generally lesser extent, the necessary driver circuitry therefor required within the ECU. It will also be understood that the electrical power required to drive the stepper motor may prove problematic in situations where batteries are not provided on particular engine configurations, the purchaser is cost sensitive or there is little electrical power available. Smaller engine applications such as chainsaws, lawn mowers and other small engine apparatus are particularly susceptible to the above problems. Stepper motors may also suffer problems in regard to long term durability and accuracy. In this respect, it is known from prior art systems that steps may be lost under high speed conditions. Further, being mechanical devices subject to certain lags, stepper motors may have a reasonably slow response. Hence, there is a need for functionally similar systems that are cheaper and technically simpler in operation.

It is the object of the present invention to provide a fuel metering pump in which the stroke of the pump may be adjusted in a manner to overcome at least some of the problems present in prior art systems.

With this object in view, the present invention provides a variable displacement metering pump for metering a fluid comprising a fluid chamber in communication with a fluid supply; and a control chamber in communication with a pressurised working fluid source wherein the relative volumes of the fluid chamber and the control chamber are variable in accordance with reciprocation of a pumping means and wherein a portion of the pumping means, which at least in part defines the control chamber, is arranged to be subject to pressure from the pressurised working fluid source, the pressure of the pressurised working fluid source, together with the time that such pressure acts on the pumping means determining the metered quantity of fluid displaced by the pumping means from the fluid chamber.

Conveniently, pressure from the pressurised working fluid source may be attenuated by attenuation means.

Conveniently, the metering pump may be employed as a fuel metering pump for an internal combustion engine, the fluid in this case being fuel. However, it is to be noted that the pump is not limited to such an application.

Conveniently, the control chamber may be communicated with the pressurised working fluid source (which, in the case of a fuel metering pump for a crankcase scavenged two-stroke internal combustion engine can advantageously be the engine crankcase chamber) by a conduit in which may be located an attenuation means such as a throttle means. From this it may be understood that the working fluid source, with which the control chamber is in communication in a crankcase scavenged two stroke internal combustion engine, may be positive and negative crankcase pressure. As an alternative, the throttle means may form part of the metering pump housing or casing.

By attenuation means is meant a means by which pressure variations in the pressurised working fluid source are attenuated or controlled to provide a pressure-time characteristic of form to operate the pumping means to achieve the desired metering of fluid for given operating conditions. The degree of attenuation may be a function of engine speed and it is not necessary that the attenuation means be a throttle. That is, other assemblies may also achieve the desired results.

Preferably, the position setting of the throttle means is selectively adjustable. Use of the throttle means allows fine control over the displacement of the pumping means to be achieved as the position of the throttle means can be selected to attenuate the variation in pressure from the crankcase or other pressurised working fluid source and hence achieve a desired level of trimming of the metered quantity of fluid or fuel displaced by the pumping means. This may be particularly beneficial for controlling the quantity of fuel delivered under engine idle conditions.

Preferably, the stroke of the pumping means is determined by a physical end stop, at least under some operating conditions, whilst under other operating conditions the pumping means has a stroke which is less than that set by the physical end stop.

Preferably, the pumping means is a piston, but may also be a flexible diaphragm or other suitable means which may be arranged to separate the fluid chamber and control chamber. In this respect, the fluid chamber may be remote from the control chamber as, for example, in a metering pump employing a metering rod extending from the piston, or adjacent thereto, as for example, in the case where the pumping means is a pressure responsive means such as a flexible diaphragm separating the fluid and control chambers.

Hence, where the pumping means is a piston supported in the working cylinder of the pump, rather than control the physical operating stops of the piston of the fuel metering pump, as is done in some prior art fuel metering systems, the fuel being delivered or metered by the fuel metering pump is controlled by throttling the driving pressure source of the piston. In this way, a separate actuator such as a stepper motor to control the amount of fuel delivered from the fuel metering pump is not required.

In the above discussion, the preferred pressurised working fluid source is an engine crankcase chamber of a two stroke engine, but other sources of on-engine pressure, which are alternating at or in relation with engine frequency or speed may conveniently be used. For example, the control chamber may be in communication with engine cylinder pressure.

In the case of a crankcase scavenged two stroke engine, when the attenuation means, say the throttle means, is attenuating the crankcase pressure signal, preferably at least under idle conditions, there is essentially a combined reduction in the available pressure to displace the pumping means since the crankcase pressure variations will be reduced due to a main air intake valve being relatively closed and also due to the effects of the throttle means. Hence, the pumping means may pump slower against the fluid or fuel pressure in the fluid chamber, any biasing means (such as a return spring) arranged to return the pumping means and any inertia and friction forces. As a result, the pumping means may complete its pumping stroke before the full possible displacement or stroke thereof has occurred. In this manner, the displacement or stroke of the pumping means is controlled by the degree of attenuation or throttling of the pressure signal from the crankcase rather than as would be determined by a physical stop of the pumping means which could otherwise be used.

A consequence of this is that, once the position of the throttle means is set, the amount of fuel delivered by the fuel metering pump becomes speed dependent for a fixed degree of throttling. In this case, idle speed is no longer under electronic control and is dependent upon the position of the throttle means. In this regard, the throttle means may be adjusted to provide a desired idle speed set point, this setting taking account of engine to engine variations and other influencing factors. Routine adjustment of the throttle means may then provide a convenient method to maintain this desired idle set point if required. In this regard, the throttle means may be mechanically adjusted by any suitable means, for example an idle adjustment screw, as known in the art of carburetted engines.

A possible desirable feature here is that throttling of the air flow, for example, may be achieved in a manner to generate "torque back-up". Thus, as the engine speed falls, the rate of flow of gases past the throttle means reduces giving rise to less pressure attenuation of the gas pressure across the throttle means. This results in an increased stroke of the pumping means and a corresponding increased quantity of fuel being metered.

In addition to the effect of the throttle means, the slower engine speed also results in a longer period of time for which the pumping means will be exposed to the crankcase pressure. Thus there will be more time for the pumping means to overcome the inertia, friction and or any biasing effects within the pump resulting in a longer stroke thereof and therefore an increased quantity of fuel being metered.

A further benefit may ensue in that, in a reverse manner to "torque backup", as the engine speed rises, the rate of flow of gases past the throttle means increases giving rise to more pressure attenuation of the gas pressure across the throttle means. Further, the increased engine speed also results in a shorter period of time for which the pumping means will be exposed to the crankcase pressure and hence there will be less time for the pumping means to overcome inertia and friction effects within the pump. Together, this results in a shorter stroke of the pumping means and a corresponding decreased quantity of fuel being metered, particularly in a two stroke engine where the air flow to the engine normally reduces due to dynamic timing effects, thus requiring a corresponding decrease in the fuelling rate.

Hence, it is evident that for a particular setting of the throttle means, the displacement or stroke of the pumping means is controlled as a function of engine speed only. Further, when the throttle means is used under idle conditions, the fuel system is essentially self-compensating.

Under off-idle conditions, the throttle means is ideally maintained in a wide open position. The pump may accordingly, at least under some off-idle engine operating conditions, have the metered quantity of fuel displaced by the pumping means determined by physical end stop(s), for example, defining a maximum stroke for the pumping means, such as a piston, the position of which end stop(s) may be varied by a mechanical system such as a cam actuated in response to driver demand. Under idle and/or some high speed conditions, the reciprocation of the pumping means would be controlled by throttling of the pressurised working fluid source, for example, the engine crankcase chamber gases.

The position of the throttle means may advantageously be varied in accordance with operator demand, ideally by a mechanical linkage between the throttle means and an operator demand means. In the case of a vehicle, the throttle means may be linked to an accelerator pedal position, or in some engine configurations, to the air intake valve position, the position of either conveniently being selected so that the appropriate degree of throttling and control of the displacement of the pumping means may be achieved.

Under cold starting conditions, an automatic fuel enrichment device such as an analogue unit which is fuel pressure driven and which behaves in a similar fashion to those used on marine engines could be employed.

A possible enrichment device may be provided, for example, in the form of a bimetallic spring. The spring is fitted to the throttle means enabling it to behave analogously to a choke on a carburettor, providing for less pressure attenuation and hence more fuel and a richer mixture when the engine is cold and providing for increased pressure attenuation and a reduced stroke of the pumping means, and hence the volume of fuel delivered, as the engine warms. The bimetallic spring may also be designed to compensate for possible internal resistance within the fuel metering pump caused, for example, by frictional and viscous drag which may vary as a function of both engine and ambient temperatures.

As an alternative, in cost sensitive markets, the operator may be provided with a manual adjustment means which the operator uses to trim the delivered fuelling level as engine operation varies with temperature. Alternatively, an automatic adjustment means which may comprise a mechanical linkage between an operator demand means and the throttle means may be provided.

It will be understood that the throttling of crankcase pressure to adjust the stroke of the pumping means need not be limited to cold start or idle operation of an engine. For example, trimming of the delivered fuel amount for other engine operating conditions may be appropriate.

The throttle means may be arranged to throttle the positive crankcase pressure (and hence the actuation force on the pumping means) and not the return stroke of the pumping means (i.e.: due to negative crankcase pressures and the return or biasing spring acting on the pumping means). In this way, the delivery stroke and hence the metered quantity of fuel delivered is controlled, however, the re-filling of the fluid chamber is not impeded and happens quickly.

One means for achieving this may be to provide a valve means such as one-way check valve arranged in a second conduit bypassing, and in parallel with, the throttle means. When the crankcase pressure becomes negative and the biasing spring begins to return the pumping means, the fluid in the control chamber has a more desirable path for air flow (ie: through the open one way valve rather than past the throttle means). In this manner, the throttling effect of the throttle means is reduced on the return stroke of the pumping means.

In some engines, particularly when operating at high speeds, the air flow per engine cycle may reduce due to the tuning of the engine. In these cases, to ensure that the appropriate air/fuel ratio for preferred operation of the engine is achieved, the fuelling rate must advantageously be reduced. That is, to avoid rich misfire, the fuelling rate of the engine should be reduced. Normally, this will need to be affected independently of the operator demand. Typically, the reduction in fuelling rate is achieved as a function of speed and demand. This reduction in fuelling rate would be very straight forward in an engine under electronic control, for example in a "Drive-By-Wire" controlled engine. However, it is not possible to achieve such control in a cam controlled fuel metering pump in which fuelling is dependent in the main upon driver or operator demand.

Conveniently, in an engine employing a metering pump as hereinabove described, the fuelling rate may be adjusted by way of the throttle means under both idle and/or high speed engine conditions as previously described. Appropriate actuation of the throttle means at such idle or high engine operating speeds can serve to attenuate the crankcase pressure signal driving the pumping means of the metering pump and hence reduce the displacement or stroke thereof. In this regard, the throttle means may be arranged such that, during idle operation, it is operating near or about its closed position, whilst at high speeds and typically wide open throttle conditions of the engine, is operating at or near its fully opened position. A suitable mechanical linkage to the throttle means would enable the throttle means to vary the degree of opening provided at such high speed and or load positions to vary the engine fuelling rate.

In conjunction with the throttle means or instead thereof, a further attenuation means may be provided to attenuate the crankcase pressure signal and hence reduce the stroke of the pumping means to maintain a desired air/fuel ratio. If desired, a pressure control means, such as a fixed or variable area orifice means, may be provided in the line communicating the control chamber of the pump with the pressurised working fluid source, typically the crankcase, such that the higher the engine speed, the more it attenuates the crankcase pressure acting on the pumping means. The stroke of the pumping means and hence the volume of fuel delivered by the metering pump may accordingly be reduced.

In a further aspect, the present invention provides a method of operation of a variable displacement metering pump for metering a fluid, said pump comprising a fluid chamber in communication with a fluid supply; and a control chamber in communication with a pressurised working fluid source;

wherein the relative volumes of the fluid chamber and the control chamber are varied in accordance with reciprocation of a pumping means and wherein a portion of the pumping means, which at least in part defines the control chamber, is subjected to pressure from the pressurised working fluid source;

the pressure of the pressurised working fluid source, together with the time that such pressure acts on the pumping means determining the metered quantity of fluid displaced by the pumping means from the fluid chamber.

Conveniently, the method is employed for the metering of fuel to an internal combustion engine, the fluid in this case being fuel. However, it is to be noted that the method is not limited to such an application.

The pressure of the pressurised working fluid source may be attenuated by use of a throttle means, located between the pressurised working fluid source and the pumping means, which allows control over the displacement of the pumping means in accordance with the position of the throttle means. In the context of delivery of fuel to a crankcase scavenged, two stroke internal combustion engine, the preferred pressurised working fluid source is the engine crankcase, but other sources of on-engine pressure which are alternating at engine frequency may conveniently be used. For example, the pressurised working fluid source may be a cylinder of the engine. In either case, the pumping means may be exposed to both positive and negative pressures.

The position of the throttle means may be controlled by the employment of a mechanical linkage between the throttle means and an operator demand means. The operator demand means may be the accelerator pedal position of a vehicle, or in some engine configurations, the air intake valve position, so that the appropriate degree of throttling and control of the displacement of the pumping means may be achieved.

The displacement of the pumping means, which may be a piston, flexible diaphragm or other suitable means, may be controlled in accordance with variations in transmitted crankcase pressure at idle operating conditions or cold start, or under other engine operating conditions. In particular, it may be desired to control the displacement of the pumping means under high engine speed conditions. In this case, a pressure control means such as a fixed or variable area orifice may be included to attenuate the crankcase pressure signal as transmitted to the pumping means of the pump. In this manner, the magnitude of the crankcase pressure signal may be increasingly attenuated as engine speed increases and trimming control over fuel delivery to the engine may be achieved.

It will be understood that, rather than throttle the crankcase or other source of pressure driving the pumping means of the fuel metering pump, under idle and/or high speed conditions, the fuel metered by the fuel metering pump may itself be throttled to achieve the same result. Alternatively, the crankcase or other source of pressure driving the pumping means could be throttled together with the fuel metered by the pump. However, it may be understood that such an embodiment is somewhat less practical. In contrast to 20–30 kPa pressure typically existing in the line supplying the pressurised working fluid source to the control chamber of the pump, the fuel pressure existing immediately downstream of an outlet of the pump is of the order of 1–2 MPa. Accordingly, fuel leakage at high pressure from any throttle means at or downstream of the pump outlet could cause certain problems. Furthermore, the metered quantities of fuel are typically quite small, of the order of cubic millimeters, which may cause difficulties in designing an appropriate throttle means to throttle fuel metered by the pump. In contrast, a throttle means to be provided in the line from the crankcase, for example, to the control chamber of the fuel metering pump, may take the form of a simple butterfly valve as is known in existing air flow control systems and is likely to cause no such problems or difficulties.

Still further, it is possible to provide the throttle means upstream of the crankcase such that the source of working fluid pressure is attenuated prior to it entering the crankcase. In such a case, the throttle means may be formed separate to or together with the main air intake throttle, or indeed the main air intake throttle alone may be used to attenuate the fluid pressure. However, whilst such a system could be made to function satisfactorily with a certain degree of engineering, it is preferable to have separate control of the fluid pressure driving the fluid metering pump. That is, it is preferable to provide a distinct throttle means downstream of the crankcase to attenuate the fluid pressure initially controlled by a main air intake throttle upstream of the crankcase.

Again, under off-idle conditions, the throttle means is ideally maintained in a wide open position. The pump may accordingly, at least under some non-idle engine operating conditions, have the metered quantity of fuel displaced by the pumping means determined by physical end stop(s), for example, defining a maximum stroke for the pumping means, perhaps a piston, the position of which end stop(s) may be varied by a mechanical system such as a cam arrangement actuated in response to driver demand. Under idle and/or some high speed conditions, the displacement or stroke of the pumping means or piston would be controlled by throttling of the pressurised working fluid source.

It will be understood that the metering pump and method as described are equally applicable to two stroke, four stroke and other engines, though the invention is especially applicable to crankcase scavenged two stroke engines. In a four stroke engine, an additional control strategy would be required to be employed so that pressure from a pressurised working fluid source only resulted in actuation of the pumping means every second cycle of the engine. Failure to implement such a strategy would result in twice as many fuelling events per cylinder firing event as necessary. Such a strategy may employ the use of a simple on/off valve.

The invention will be more clearly understood from the following description of a preferred embodiment thereof made with reference to the accompanying drawing which is a sectional diagram of a fuel metering pump in accordance with the present invention.

The fuel metering pump has a body 1 in which are provided a fuel inlet passage 3 and a fuel outlet passage 5. The fuel inlet passage 3 delivers fuel to a fuel metering chamber 19 via a filter means 7. Extending into the chamber 19 is a metering rod 9 whose movement within a bore 10 and the chamber 19 determines the amount of fuel metered through the outlet passage 5.

At its upper end 11, the fuel metering rod 9 is arranged rigid with a piston 15. Adjacent its lower end 12, there is a one-way valve assembly 17 controlling communication between the inlet passage 3 and the fuel metering chamber 19. A one-way valve 21 controls the flow of fuel from the fuel metering chamber 19 into the fuel outlet passage 5 which conducts the fuel to a fuel injector or fuel injectors (not shown).

The piston 15, rigidly connected to the fuel metering rod 9 defines an upper control chamber 22 and a lower chamber 24 and moves in the cylinder 23 in response to the application of fluid pressure to the control chamber 22. The lower chamber 24 is sealed from the control chamber 22 and vented to atmosphere via the orifice 20. The application of fluid pressure will displace the piston 15 and hence the fuel metering rod 9 downwards and, in doing so, will cause the one-way valve 17 to close and the one-way valve 21 to open so that some or all of the fuel in the fuel metering chamber 19 and within the bore 10 is discharged through the fuel outlet passage 5. It will be appreciated that, by varying the stroke of the piston 15, and accordingly the fuel metering rod 9, the quantity of fuel delivered from the bore 10 and the fuel metering chamber 19 during each stroke of the fuel metering rod 9 can be varied in accordance with the fuelling requirement of an engine, perhaps a crankcase scavenged two stroke engine in a preferred embodiment of the invention, though other two stroke and four stroke engines or other engines could likewise employ such a pump.

Under off-idle conditions, the variation in the quantity of fuel delivered to the engine may be achieved by the variation in position of a cam 25 rotatably mounted on an axis 27 to co-operate with a upper end piston stop 29. Together with a bottom end stop 28, the cam 25 and upper end piston stop 29 determine the stroke of the piston 15. Consequently, for different positions of the cam 25, the quantity of fuel delivered from the fuel metering chamber 19 and bore 10 each stroke may be increased or reduced. Operation of the cam 25 may be directly driver controlled. In the embodiment shown, the cam 25 is controlled under off-idle conditions by an ECU managed means, such as stepper motor 31 so that the quantity of fuel delivered to the engine is related to the demand and speed of the engine.

Conveniently, the pressurised fluid supplied to upper control chamber 22 to actuate the piston 15 is, in the case of a crankcase scavenged two stroke cycle engine, compressed air derived from the pumping action in the crankcase of the engine. However, other pressurised fluids and sources of pressure may be employed to actuate the piston 15. For example, the pressure within the engine cylinder(s) could be used as a source of pressure. Desirably, the source of pressure would, in a similar manner to crankcase pressure, be such as to fluctuate at engine frequency.

The arrangement described above may operate quite satisfactorily under off-idle conditions, however under idle or near idle conditions, the low fuelling rates required per engine cycle may require the pump to be controlled in a different manner.

Accordingly, upper control chamber 22 of the pump 1 is shown to be in communication with a conduit 33 in which is located a throttle means in the form of a butterfly valve 35. It is to be noted that the throttle means need not be located separately from the pump 1 and may be formed as a part thereof. Other throttle valve types may also be employed as will be understood by those skilled in the art upon reading of this disclosure.

Conduit 33 communicates with a crankcase 37 of a crankcase scavenged two stroke engine and pressure in chamber 22, for a fixed setting of the butterfly valve 35, will vary in accordance with an attenuated crankcase pressure signal from the crankcase 37. Under off-idle conditions, as previously described hereinabove, the cam 25 may be used to control the stroke of the piston 15. Under such conditions, the butterfly valve 35 will be typically be in a wide open position.

At idle, or near idle, the setting of the butterfly valve 35 is selected to provide appropriate attenuation of the pressure signal from the crankcase 37 to provide trimming control over the stroke of piston 15 and consequently of the quantity of fuel delivered by the pump 1. The trimming control is achieved by appropriate throttling of the fluid flow from the crankcase 37 to achieve desired operation of the fuel metering pump. This can be achieved by tuning the butterfly valve 35 to provide a damped pressure signal that acts, via control chamber 22, on the piston 15. In this way, the stroke of the piston 15 can be maintained within a desired range during idle conditions with delivery of fuel to the engine, as discussed hereinbefore, being directly dependent on engine speed.

The degree of throttling is selected to achieve the desired rate of fuel delivery throughout the idle range. Thus, during low idle the throttle means or butterfly valve 35 is substantially closed providing a highly attenuated pressure signal that enables the pump 1 to operate at the desired slow rate. As the engine idle speed increases, the butterfly valve 35 is opened wider, not necessarily in a linear manner, until the wide open position thereof is reached. At this point, if desired, the stroke of the piston 15 may be controlled using the cam system described hereinabove. This latter condition typically equates to the engine moving off-idle.

In this manner, during idle operation, the quantity of fuel delivered per engine cycle is speed dependent for a fixed degree of throttling and, not being controlled by an electronic control unit, idle speed may be adjusted simply by adjusting the setting of the throttle means, for example, through adjustment of a simple adjustment screw.

Further, a convenient and inexpensive manner in which to provide an enrichment device for the system as described is to employ a bimetallic spring that responds to changes in engine temperature to achieve a desired setting for the butterfly valve 35. Fuel enrichment can then be attained as required, for example, at cold start. The spring characteristic may be selected by calculation and/or by trial and error to attain the desired stroke of piston 15 for a given engine speed. However, a bimetallic spring need not be employed and, if desired, could be replaced with another mechanism capable of achieving the desired control over the position of the butterfly valve 35. For example, the position of butterfly valve 35 could be varied by use of a suitable linkage between driver throttle pedal position and the valve 35. Whatever the mechanism employed, the fuel metering pump will operate at the desired rate delivering the desired amount of fuel to the internal combustion engine for the particular engine operating conditions, the fuel injection or delivery events themselves typically being under control of an electronic control unit (ECU).

A benefit which arises as a consequence of the above described system is that, at idle and low engine speeds, the throttling of the air flow by the butterfly valve 35 will typically generate "torque back-up". That is, as the engine speed falls, the flow rate of air past butterfly valve 35 reduces with resultant less pressure attenuation of the air pressure across the valve 35. This results in an increased stroke of piston 15 and a correspondingly increased quantity of fuel being metered which will bring the engine speed up to the desired setting.

The slower engine speed will also be understood to provide a longer period of time in which piston 15 is exposed to pressure from crankcase 37. Accordingly, more time is available for the piston 15 to overcome inertia and friction effects within the pump 1. This results in a longer stroke of the piston 15 and an increase in the quantity of fuel being metered to the engine.

At idle or such low engine speeds, as the engine speed increases, an opposite effect occurs. As the engine speed rises, the flow rate of air past butterfly valve 35 increases with a resultant greater degree of attenuation of pressure across butterfly valve 35. The increased engine speed also causes a shortening of exposure of piston 15 to pressure from crankcase 37. Accordingly, there is less time for the piston 15 to overcome inertia and friction effects within the pump. The resulting shorter stroke of piston 15 results in a corresponding decrease in the quantity of fuel being metered to the engine. Hence, the engine speed will fall to the desired setting. In this respect, at such idle and low engine speeds, the fuel system is essentially self-compensating.

The system as described may also be used to control the engine fuelling rate at certain high engine speeds. In certain engines, particularly when operating at high speeds, the tuning of the engine may cause the air flow per engine cycle to reduce. Hence, to maintain an appropriate air/fuel ratio for preferred operation of the engine, it is required to reduce the fuelling rate to the engine. Unlike other engines in which fuelling is dependent in the main upon driver or operator demand, the present system can be used to adjust the fuelling rate by way of the butterfly valve 35. Appropriate actuation of the butterfly valve 35 can serve to attenuate the crankcase pressure signal from the crankcase 37 and hence reduce the stroke of the piston 15.

In this regard, the butterfly valve 35 may be arranged such that, during idle operation it is operating near or about its closed position, whilst at high speeds, it is operating at or near its fully opened position. This latter position would typically correspond to wide open throttle operating conditions of the engine. A suitable mechanical linkage to the butterfly valve 35 would enable the valve to be actuated at such high speeds or load positions to reduce the engine fuelling rate and hence avoid rich misfire.

Together with the butterfly valve 35 or separately thereto, a further pressure control means, such as a fixed or variable area orifice, could be provided in the conduit 33 such that the higher the engine speed, the more the pressure control means attenuates the crankcase pressure acting on the piston 15. Hence, the stroke of the piston 15 and, consequently, the volume of fuel delivered by the metering pump may be reduced in a desired manner.

Although the system as above described is a hybrid system in the sense that cam control over the stroke of piston 15 may be implemented under off-idle conditions, this is not essential. In certain cost-sensitive markets, it may be desired to eliminate the use of a cam and stepper motor altogether. This is possible using the system of the present invention and the cam 25 and stepper motor 31 may be designed out of the pump with the stroke of piston 15 remaining predominately under the influence of fluctuations in the pressure from the crankcase 37.

In the above described embodiment, the metering pump employs a metering rod 9 displaced in correspondence with variation in pressure from the engine crankcase 37. The metering chamber 19 is in fact remote from the control chamber 22. However, rather than provide a separate metering chamber 19, the pump could provide the metering chamber in adjacent relationship to the control chamber 22. In such an embodiment, the metering chamber is simply separated from the control chamber 22 by a pumping means, for example a flexible diaphragm, without a metering rod "extension".

Further, in the example described hereinabove, the upper end stop 29 determines the stroke of the pumping means or piston 15 that is, when the crankcase pressure is throttled, the piston 15 typically does not complete its full stroke to the bottom stop 28. The return stroke then returns the piston 15 to the upper end stop 29 of the pump 1 or that as determined by the cam 25.

The reverse of this could be used to control the fuelling rate delivered by the pump 1. Rather than prevent the piston 15 from reaching its bottom stop 28 when the crankcase pressure is being throttled, the system could be designed so that the piston 15 does not return to the upper end stop 29 and always contacts its bottom end stop 28. Thus, rather than control the pumping or delivery stroke of the piston 15, the return or re-filling stroke of the piston 15 may be controlled. Hence, the fluid chamber only fills with a certain level of fuel as determined by the controlled return stroke of the piston 15. This volume of fuel may then be delivered during the next delivery stroke.

Hence, the pump may operate in the reverse sense in that the quantity of fuel delivered is determined by a controlled return stroke of piston 15 rather than a controlled pumping stroke as described in the previous embodiment. That is, fuel is metered into the pump 1 rather than out of the pump.

It will be understood that an extension of the above is the avoidance of employment of both top and bottom stops for piston 15. Hence, the piston 15 can be controlled to cycle between its physical stops, this control determining the volume of fuel delivered by the pump 1. In this case, if the engine for which the pump is metering fuel is operating other than homogeneously, a further device may be required to determine the effective piston stroke in order to determine the quantity of fuel delivered to the engine.

The above embodiment is not intended to be limiting of the invention and other embodiments may be implemented within the scope of the invention and will be understood to form part of the present invention. In particular, the pump and method of delivery of fluid may be suitable for applications other than metering of fuel to an engine.

The claims defining the invention are as follows:

1. A fluid metering system for metering a fluid in an internal combustion engine having a variable displacement pump comprising:

a fluid chamber in communication with a fluid supply;

a control chamber in communication with a pressurised working fluid source of which the pressure alternates in relation to engine frequency or speed;

and a throttle means, wherein the relative volumes of the fluid chamber and the control chamber are variable in accordance with reciprocation of a pumping means and wherein a portion of the pumping means, which at least in part defines the control chamber, is arranged to be subject to pressure from the pressurised working fluid source, said pressure being attenuable by the throttle means for controlling the degree of attenuation of the pressure from said pressurised working fluid source; the pressure of the pressurised working fluid source, together with an amount of time that such pressure acts on the pumping means determining the metered quantity of fluid displaced by the pumping means from the fluid chamber.

2. The fluid metering system of claim 1, wherein said throttle means for controlling the degree of attenuation of the pressure from said pressurised working fluid source is adjustable.

3. The fluid metering system of claim 1, wherein the metering pump is an oil or fuel metering pump for an internal combustion engine.

4. The fluid metering system of claim 3 wherein said pressurised working fluid source supplies fluid at pressure variable with engine speed.

5. The fluid metering system of claim 3 wherein the throttle means determines the stroke of said pumping means at or near engine idle operating conditions.

6. The fluid metering system of claim 3 wherein said pressurised working fluid source is an engine crankcase chamber.

7. The fluid metering system of claim 6 wherein the throttle means is located in a conduit communicating said crankcase chamber with said control chamber.

8. The fluid metering system of claim 3 wherein said throttle means is connected with an operator demand means.

9. The fluid metering system of claim 3 wherein a valve means is arranged in a bypass conduit bypassing the throttle means.

10. A method of operating a variable displacement metering pump for metering a fluid in an internal combustion engine, said variable displacement metering pump comprising a fluid chamber in communication with a fluid supply and a control chamber in communication with a pressurized working fluid source of which the pressure alternates in relation to engine frequency or speed, the method comprising the following steps:

varying the relative volumes of the fluid chamber and the control chamber in accordance with reciprocation of a pumping means;

subjecting a portion of the pumping means, which at least in part defines the control chamber, to pressure from the pressurized working fluid source;

attenuating said pressure by a throttle means for controlling the degree of attenuation of the pressure from said pressurised working fluid source; and determining the metered quantity of fluid displaced by the pumping means from the fluid chamber using the pressure of the pressurised working fluid source, together with an amount of time that such pressure acts on the pumping means.

11. The method of claim 10 wherein said pump meters oil or fuel for use in an internal combustion engine.

12. The method of claim 10 wherein said throttle means for controlling the degree of attenuation of the pressure from said pressurized working fluid is adjustable.

13. The method of claim 11 wherein the throttle means determines the stroke of said pumping means at or near engine idle operating conditions.

14. The method of claim 11 wherein said pressurised working fluid source is an engine crankcase chamber.

15. The method of claim 11 wherein a fuel enrichment device adjusts said throttle means under cold starting conditions.

16. The method of claim 11 wherein the stroke of said pumping means is determined as a function of engine speed only.

17. The method of claim 10 wherein the degree of attenuation is a function of engine speed.

* * * * *